United States Patent [19]

Barr

[11] Patent Number: 4,558,991

[45] Date of Patent: Dec. 17, 1985

[54] WAVE PUMP ASSEMBLY

[76] Inventor: Robert A. Barr, P.O. Box 4476, Virginia Beach, Va. 23454

[21] Appl. No.: 690,319

[22] Filed: Jan. 10, 1985

[51] Int. Cl.[4] ..... F04B 23/12; F04B 43/12; F04C 5/00

[52] U.S. Cl. ..... 417/199 R; 417/475; 418/48; 418/160

[58] Field of Search ..... 418/48, 160, 220; 417/199, 474, 475

[56] References Cited

U.S. PATENT DOCUMENTS

| | | | |
|---|---|---|---|
| 2,621,605 | 12/1952 | Mark, Jr. | 417/199 R |
| 3,233,553 | 2/1966 | Chanton | 417/475 |
| 3,652,192 | 3/1972 | Kramer et al. | 418/125 |
| 3,804,561 | 4/1974 | Kramer | 418/96 |

FOREIGN PATENT DOCUMENTS

| | | | |
|---|---|---|---|
| 2905917 | 8/1979 | Fed. Rep. of Germany | 418/48 |

*Primary Examiner*—John J. Vrablik

*Attorney, Agent, or Firm*—Mason, Fenwick & Lawrence

[57] ABSTRACT

A positive displacement wave pump assembly for pumping liquid or gaseous or plastic fluids or mixtures thereof with solids or the like, including an elongated cylindrical tube or barrel having an upstream end and a downstream or discharge end, a drive shaft rotatable in portions of the barrel adjacent the upstream end, and a positive displacement wave pump is located in the barrel near the outlet end having a stator frame and a rotor member rotatable therein coupled to and driven by the driveshaft. The rotor member has an outer surface of developed helical coutour providing a plural turn helical thread of wide rounded form to position a stack of slidable sealing discs guided for diametric sliding movement by the rotor passing therethrough to form a seris of pumping pockets which progress longitudinally through the pump.

6 Claims, 8 Drawing Figures

WAVE PUMP ASSEMBLY

PRIOR RELATED APPLICATIONS

The present invention relates to my earlier U.S. patent application Ser. No. 648,040 filed Sept. 6, 1984 now U.S. Pat. No. 4,519,712 entitled Extruder Screw and Positive Displacement Pump Assembly, and my U.S. patent application Ser. No. 680,971 filed Dec. 12, 1984 entitled Extruder Screw and Positive Displacement Wave Pump Assembly.

BACKGROUND AND OBJECTS OF THE INVENTION

The present invention relates in general to pumping devices for pumping liquid or gaseous or plastic fluids or mixtures of solids and gaseous or liquid fluids, and more particularly to wave pump assemblies having a rotor member in the form of a helix with smooth, rounded threads and means activated by the helix to generate a continuous wave motion providing longitudinally moving pockets for moving the medium to be pumped.

Heretofore, various pumping devices have been proposed to effect pumping of a medium, such as liquid or gaseous fluids of various types, by a pump structure involving a helical rotor, usually having rounded helical threads, and a stator also providing a bore which is of rounded helical configuration having a different pitch from the helical rotor, providing pumping pockets which progress longitudinally from the input end to the output end of the pump. A number of such pump devices have been developed and marketed by Robins & Myers Inc. of Springfield, Ohio, under the name Moyno gear pumps, involving principles of pump structure disclosed in various U.S. patents to R. J. L. Moineau. Examples of these patents are U.S. Pat. Nos. 1,892,217 and 2,028,407.

However, certain disadvantages have been identified as in an inherent property of that type of construction. With the Moineau type pump, either the rotor or the stator must be free to orbit around the center of rotation of the input drive shaft or other driving mechanism. This is because of the nature of the Moineau type pump wherein the confronting surfaces of the rotor and stator are rounded helical thread configurations of different pitch providing pumping pockets which progress longitudinally from the input to the output end of the positive displacement pump mechanism. Because of the necessity of enabling either the rotor or the stator, usually the rotor, to orbit around the center of rotation of the input shaft, a rather complex coupling must be provided between the drive shaft and the input end of the rotor of the pump mechanism to allow this relative movement of the center of rotation of the pump rotor relative to the center of rotation of the drive shaft.

An object of the present invention is the provision of a novel positive displacement pump assembly employing a helical rotor with smooth rounded helical threads, which eliminates the need for a coupling to accommodate orbiting of the pump rotor, and provides for greater capacity for a given rotor length and thread pitch than Moineau type pumps, and provides continuous and positive displacement pumping of the fluid or other flow medium by generating a continuous wave motion providing volume displacement which is utilized more efficiently to pump the medium.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
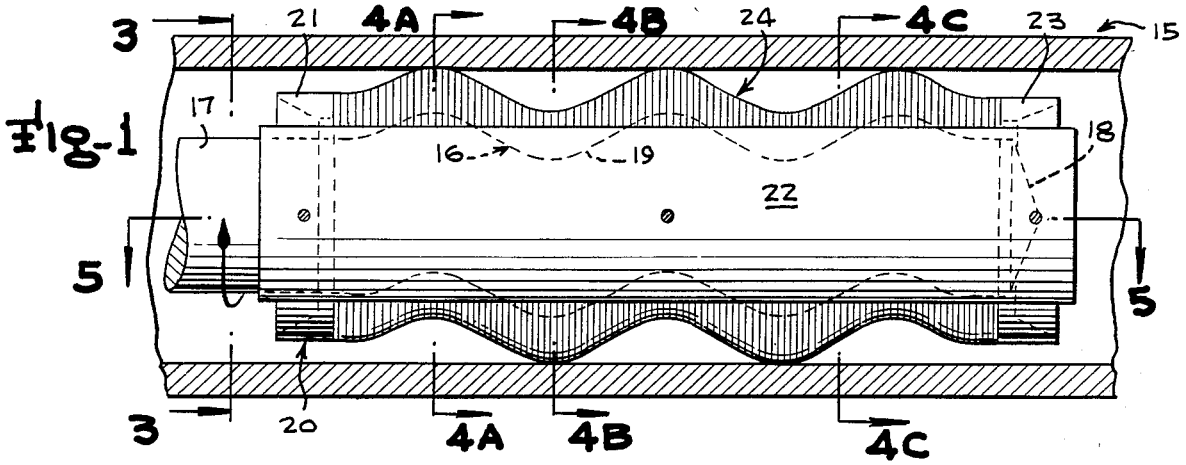
FIG. 1 is a somewhat diagramatic side elevational view of the positive displacement wave pump of the present invention, with the barrel or housing for the stator and rotor components shown in section.
Figure 2:
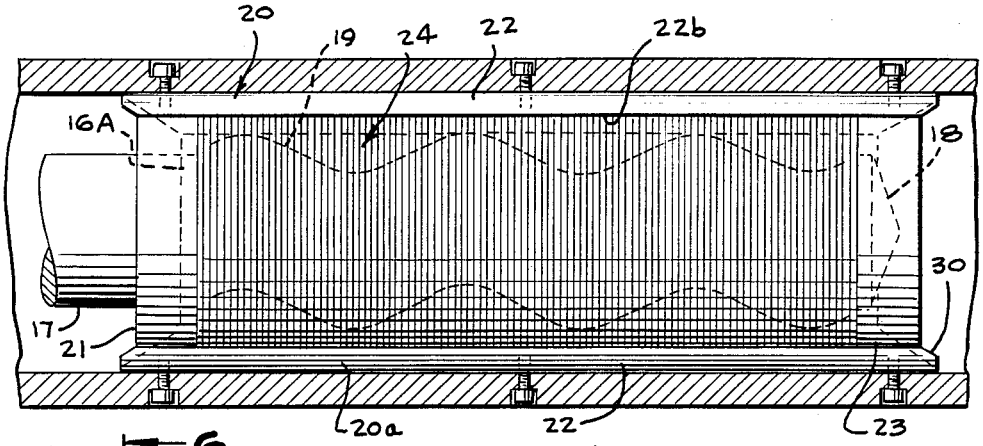
FIG. 2 is a top plan view of the wave pump shown in FIG. 1, also with the barrel or housing shown in section.
Figure 3:
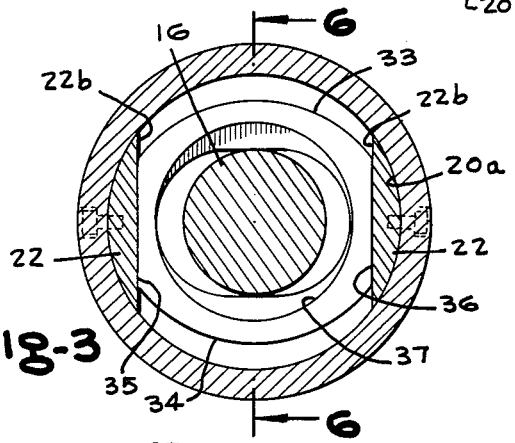
FIG. 3 is a vertical transverse section view taken at the inlet end of the wave pump along line 3—3 of FIG. 1.

Referring to the drawings, wherein like reference characters designate corresponding parts throughout the several figures, the positive displacement wave pump of the present invention is indicated generally by the referenced character 15 and includes an elongated helical rotor member 16 having a cylindrical upstream end portion **16*a* coupled in any desirable manner to a drive shaft 17. The downstream end portion of the rotor 16 is indicated at 18** and may be of any desirable configuration, such for example as an axial short cylindrical portion terminating in a tapered conical end surface as shown.

The portions of the rotor 16 between the cylindrical upstream end portion 16A and the downstream end portion 18 form a helically contoured section 19 similar to the configuration of the exterior surface of the rotor of a Moyno gear pump of the types produced commercially by Robbins & Myers, Inc. and embodying the principles disclosed in U.S. patents to R. J. L. Moineau, such as U.S. Pat. Nos. 1,892,217 and 2,028,407 previously identified. The helically countoured rotor outer surface of the helical rotor portion 19 define what may be described as helical threads of wide rounded form forming a plurality of rounded helical threads or turns orbiting about the extended center axis of the drive shaft 17 and the center axes of the inlet cylindrical rotor porltion 16A and downstream end portion 18. A stator frame assembly indicated generally at 20 spans most of the axial length of the wave pump section rotor 16, and includes a first frame member having an inlet portion 21 and side frame portion 22 integrally joined together and an outlet end portion 23 collectively outwardly surrounding the rotor 16 and capturing a stack of slide discs indicated generally at 24 forming sealing discs.

The stator frame member 20, as will be apparent from the drawings, has a cylindrical outer perimeter indicated at **20*a* along the two horizontally opposite lateral portions thereof over the span of the inlet portion 21, side frame portions 22 and outlet end portion 23, conforming to the inner diameter of the cylindrical confronting surface of the barrel or bore of the housing tube, to fit tightly against the confronting surface of the housing barrel or bore and be fixed there against by any suitable means. As will be apparent particularly from FIGS. 5 and 6, the inlet end portion of the stator frame member 20 has a beveled or camphored throat 25 lying in a truncated conical path concentric with the center axis of the rotor 16 joining a cylindrical inlet passage portion 26 which extends to a shoulder formation 27 forming the upstream bearing shoulder for the stack of slide discs 24**.

The opposite side frame portions 22 of the stator frame member 20 extending from the inlet portion 21 to the outlet end portion 23 have a cylindrical outer or exterior surface 20*a* and a straight or rectilinear inner surface 22*b* defining guide surfaces for the opposite lateral edges or flats of the slide discs 24 limiting them to rectilinear reciprocative sliding movement parallel to the vertical axis only, through the center axis of the rotor 16.

The downstream end of the slide frame portion 22 of the stator frame member 20 provides an upstream annular shoulder face 28 confronting the slide disc 24 at the downstream end of the pack of slide discs, coactive with the shoulder formation 27 of the inlet portion 21 to capture the stack of slide discs 24 therebetween.

Figure 5:
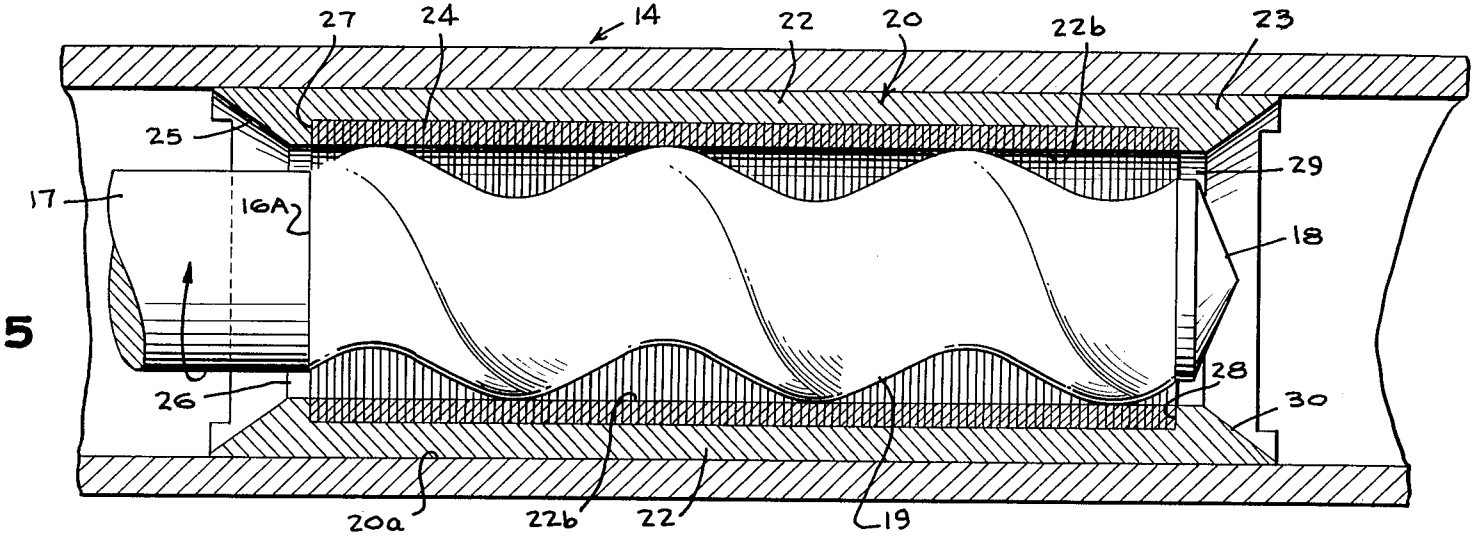
FIG. 5 is a horizontal longitudinal section view of the wave pump, taken along the line 5—5 of FIG. 1.
Figure 6:
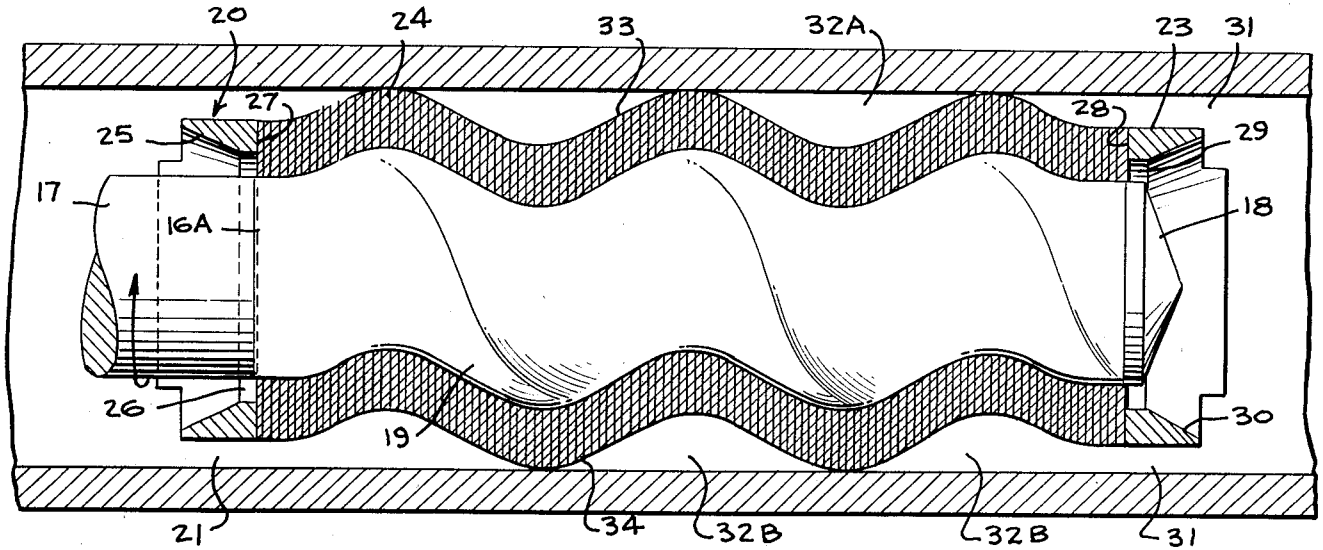
FIG. 6 is a vertical longitudinal section view of the wave pump, taken along the line 6—6 of FIG. 3.

As will be seen particularly from FIGS. 5 and 6, the outlet member 23 has a cylindrical bore portion 29 concentric with the center axis of the rotor 16 of the same diameter as the major axis diameter of the elliptical or oval center opening of the slide discs as later described, which merges into an outwardly beveled or flared frusto conical surface portion 30 forming the discharge or outlet opening for the assembly. Diametrically opposite portions of this beveled surface 30 are provided with passages 31 communicating with the downstream ends of the spaces 32A and 32B above and below, respectively, the cylindrically curved arcuate upper and lower edge portions 33, 34 of the discs 24 at vertically diametrically opposite portions of the outlet end portion 23.

Figure 4A:
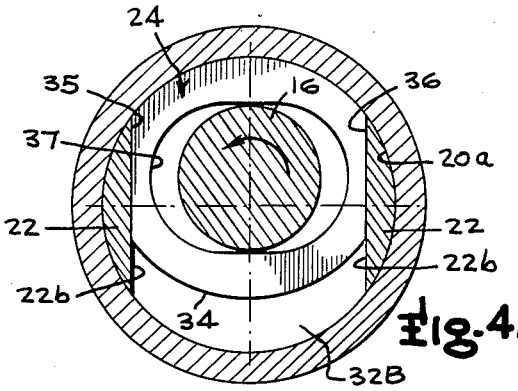
FIGS. 4A, 4B and 4C are transverse vertical section views taken along the lines 4A—4A, 4B—4B and 4C—4C of FIG. 1, showing positions of the rotor and slide discs of the disc pack at the sectional positions indicated.
Figure 4C:
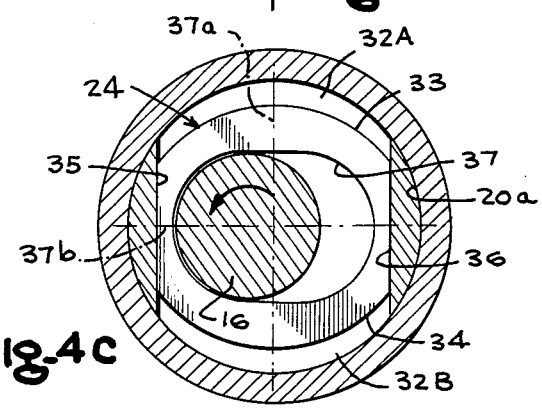
Figure 4B:
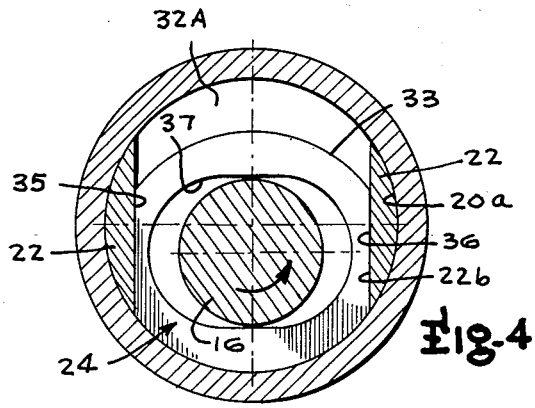

As will be apparent from FIGS. 4A–4C, each of the discs 24 are of identical configuration, wherein the outer diameter or edge is in the shape of a twice interrupted or truncated circular or cylindrical shape interrupted by two diametrically opposite flats or straight edge sections 35,36 along chords of the circle in which the upper and lower arcuate cylindrical edges lie, providing parallel vertically extending straight edge surfaces 35 and 36 which slidably bear against confronting surfaces of the side frame portions 22 of the stator frame member 20. Thus the stator frame member 20 maintains the pack of sealing discs 24 in a face-to-face contacting stacked array of discs each capable of freely sliding vertically relative to each other along the vertical axis through the center of the barrel or bore of the housing paralleling the planes of the vertical flats or straight edges 35, 36. The center opening 37 of each of the discs 24 is in the form of a laterally elongated oval having a vertical minor axis 37*a* and a horizontal transverse major axis 37*b* to accommodate the maxmum lateral span of the crests of the rounded helical threads of the rotor 16. The dimension of the minor axis 37*a* corresponds exactly to the diameter of the rotor 16 in the cylindrical portions thereof and the diameter of any circular cross-section of the helical thread portion thereof, so that the discs 24 are shifted vertically up and down relative to each other to provide wave patterns resembling what is illustrated in FIGS. 1 and 6 providing pumping pockets which progress longitudinally from the inlet end to the outlet or discharge end of the wave pump section as the helically threaded rotor 16 is rotated by the drive shaft 17.

By the above described construction, wherein the positive displacement wave pump section 15 is coupled to and driven by the drive shaft 17, the fluid medium being fed to the inlet end flows into the passages or spaces lying outwardly of the outer periphery of the upstream inlet portion 21 of the stator frame member 20 and the confronting surface of the barrel of the housing and the spaces between the convex arcuate cylindrical edges 33,34 of the sealing slide discs 24 and the confronting surface the barrel, and the fluid medium also flows into the throat 25 of the inlet end portion 21 of the stator frame member 20 and passes into the spaces occurring between the oval shaped center opening 37 of the discs 24 at the outer regions of the major axis 37*b* thereof and the exterior surface of the circular cross-section rotor 16. Since the surfaces of the center openings 37 of the discs 24 contact the exterior surface of the rotor 16 all along its length down the center line of the pump, this contact creates a sealing line, preventing the fluid medium from leaking back so that it must move with the volume being displaced by the rotor shape as it rotates. Also, the convex arcuate curved outer surfaces 33,34 of the discs are positioned in a pattern and progressively brought into contact with the confronting surfaces of the barrel to create a series of pumping pockets between the outer convex edges 33,34 of the sealing discs 24 and the surface of the barrel, which pumping pockets are moved longitudinally through the pump forcing the fluid medium material to move towards the discharge end of the positive displacement wave pump.

Because of the design of the components of the positive displacement wave pump, high pressure at the outlet end, which would normally be acting on the full disc area and would cause very high frictional forces between the discs, is releaved, since the configuration of the outlet member 23 is such that most of the projected area of the cross-section is transferred by the outlet member 23 to the barrel. Conversely, the inlet portion 21 of the stator frame assembly 20 is designed to exert the full inlet pressure onto the disks themselves thus counteracting any pressure from the outlet end. Because of the construction, the inlet portion 21 of the stator frame assembly 20 is free to undergo some movement in the appropriate direction so that the inlet pressure is free to act on the discs 24.

The above described positive displacement wave pump provides an arrangement wherein neither the rotor nor the outer portion of the wave pump have to be free to orbit, as would be the case in the use of a Moineau type pump arrangement, so that no coupling is required and the rotor can be rigidly attached to the end portion of a drive shaft rotating fixed axis. Thus because of the design of the present construction, some of the fluid medium being pumped passes into the spaces defined between the surfaces of the oval center opening 40 of the discs 24 and the exterior surface of the circular cross-section rotor 16, which effects a significant increase in pumping capacity due to the pumping action occurring between the helical surface of the rotor 16 and the bore of the discs 24 defined by their oval center opening. This pumping of the fluid medium in the spaces defined between the rotor 16 and the bore of the discs 24 permits an increase of about 50 percent in the pumping capacity as well as achieving good lubrication of the contact points between the rotor surface and the surfaces of the disc openings 40 which see a lot of load.

I claim:

1. A wave pump assembly for pumping fluid medium comprising gaseous or liquid fluids or mixtures thereof with solids or the like, comprising a barrel defining an elongated cylindrical bore having an upstream end and an outlet end, drive shaft means journaled for rotation about the center axis of said bore, a positive displacement wave pump in said bore located between said upstream end and said outlet end, said pump having a stator frame provided with cylindrical outer surface portions engaging and conforming to the surface of said cylindrical bore and being supported against rotation in the bore, a rotor member having a helically contoured outer surface defining a plural turn helical thread formation of wide rounded form to orbit about the extended center axis of said drive shaft, means coupling said rotor member to the discharge end portion of said drive shaft to be driven thereby for rotation in the stator frame, a slide disc stack of a plurality of slidable sealing discs in face to face contact with each other extending along the major portion of the axial length of the stator frame, means supporting said discs for reciprocative sliding movement parallel to a first diametric plane of said cylindrical bore, said cylindrical bore having confronting surface portions facing the discs along the extent of said slide disc stack, the slide discs forming sealing discs having opposite outwardly convex cylindrically curved surface edge portions to be moved toward said confronting surface portions of said cylindrical bore into sealing engagement therewith and be withdrawn to a range of positions spaced from said bore surface portions towards the center axis thereof by said rotor member upon rotation of the latter, the discs having shaped center apertures receiving the rotor member therethrough and accommodating movement of the full diametric range of movement of the crests of said helical thread means in a second diametric direction perpendicular to said first diametric plane, the rotor and sealing slide discs and confronting surface of said bore forming a series of pumping pockets between the convex outer edge portions of the sealing discs and the surface of the bore which pumping pockets are moved longitudinally through the pump to force the fluid medium to move toward the discharge end of the positive displacement wave pump and the rotor and bounding surfaces of said apertures of the discs also forming pumping pockets to force the fluid medium to move through said apertures toward said discharge end.

2. A wave pump assembly as defined in claim 1, wherein said means supporting said discs includes a pair of diametrically opposite side frame portions of said stator frame joining an inlet portion and extending substantially the actual length of the slide disc stack spaced transversely from the center axis of the bore in said second diametric direction and having inwardly facing guide surfaces in sliding contact with said slide discs to confine movement of the slide discs to reciprocative movement parallel to said first diametric plane.

3. A wave pump assembly as defined in claim 2, wherein said guide surfaces of said side frame portions are flat surfaces lying in a pair of planes paralleling said first diametric plane and said slidable sealing discs are in the shape of thin truncated circular discs having a pair of opposite flat edge portions extending along chords of the circular path of said cylindrically curved edge portions of the discs equally spaced from the center of the disc and positioned in sliding contact with the guide surfaces of said side frame portions to be guided thereby.

4. A wave pump assembly as defined in claim 1, wherein said stator frame has a cylindrical upstream end portion including a pair of opposite circumferential interruptions in the outer portion thereof in the direction of said first diametric plane defining passages for admitting the fluid medium into the pocket formations defined between the outer curved edge portions of the discs and the confronting surface of the bore and having an upstream facing bevelled throat and passages therefrom communicating with spaces between the center apertures of the discs and the helically contoured outer surface of the rotor member in said second diametric direction for passage of the fluid medium through the portions of said shaped center apertures of the discs not in sealing contact with the rotor member contoured outer surface.

5. A wave pump assembly as defined in claim 2, wherein said stator frame has a cylindrical upstream end portion including a pair of opposite circumferential interruptions in the outer portion thereof in the direction of said first diametric plane defining passages for admitting the fluid medium into the pocket formations defined between the outer curved edge portions of the discs and the confronting surface of the bore and having an upstream facing bevelled throat and passages therefrom communicating with spaces between the center apertures of the discs and the helically contoured outer surface of the rotor member in said second diametric direction for passage of the fluid medium through the portions of said shaped center apertures of the discs not in sealing contact with the rotor member contoured outer surface.

6. A wave pump assembly as defined in claim 3, wherein said stator frame has a cylindrical upstream end portion including a pair of opposite circumferential interruptions in the outer portion thereof in the direction of said first diametric plane defining passages for admitting the fluid medium into the pocket formations defined between the outer curved edge portions of the discs and the confronting surface of the bore and having an upstream facing bevelled throat and passages therefrom communicating with spaces between the center apertures of the discs and the helically contoured outer surface of the rotor member in said second diametric direction for passage of the fluid medium through the portions of said shaped center apertures of the discs not in sealing contact with the rotor member contoured outer surface.

* * * * *